US006817292B2

(12) United States Patent
Gerner et al.

(10) Patent No.: US 6,817,292 B2
(45) Date of Patent: Nov. 16, 2004

(54) PRINTING UNIT

(75) Inventors: Erich Max Karl Gerner, Bütthard (DE); Manfred Herrmann Liebler, Erlenbach (DE); Ewald Röthlein, Retzstadt (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/363,254

(22) PCT Filed: Sep. 17, 2001

(86) PCT No.: PCT/DE01/03557

§ 371 (c)(1),
(2), (4) Date: Mar. 7, 2003

(87) PCT Pub. No.: WO02/24452

PCT Pub. Date: Mar. 28, 2002

(65) Prior Publication Data

US 2004/0050270 A1 Mar. 18, 2004

(30) Foreign Application Priority Data

Sep. 20, 2000 (DE) ..... 100 46 368

(51) Int. Cl.[7] ..... B41F 5/04
(52) U.S. Cl. ..... 101/217; 101/177
(58) Field of Search ..... 101/177, 217

(56) References Cited

U.S. PATENT DOCUMENTS

| | | | | |
|---|---|---|---|---|
| 4,394,835 | A | * | 7/1983 | Gertsch et al. ..... 101/177 |
| 4,753,168 | A | * | 6/1988 | Theilacker et al. ..... 101/177 |
| 4,934,265 | A | * | 6/1990 | Knauer ..... 101/177 |
| 5,331,890 | A | * | 7/1994 | Miyoshi et al. ..... 101/177 |
| 5,701,818 | A | | 12/1997 | Mohrmann |
| 5,950,538 | A | * | 9/1999 | Puschnerat ..... 101/217 |
| 5,983,794 | A | | 11/1999 | Emery |
| 6,205,926 | B1 | | 3/2001 | Dufour |
| 6,332,397 | B1 | | 12/2001 | Bolza-Schünemann et al. |
| 6,338,298 | B2 | * | 1/2002 | Schneider et al. ..... 101/179 |
| 6,408,748 | B1 | | 6/2002 | Hajek et al. |
| 6,474,232 | B1 | | 11/2002 | Weschenfelder |
| 2001/0017087 | A1 | | 8/2001 | Schneider et al. |

FOREIGN PATENT DOCUMENTS

| | | | |
|---|---|---|---|
| DE | 44 30 693 | A1 | 3/1996 |
| DE | 196 03 663 | A1 | 8/1997 |
| DE | 197 32 330 | A1 | 2/1999 |
| DE | 198 48 390 | A1 | 4/2000 |
| DE | 199 42 619 | A1 | 4/2000 |
| EP | 0 644 048 | A2 | 3/1995 |
| EP | 0 768 174 | A1 | 4/1997 |
| EP | 0 644 048 | B1 | 7/1999 |
| EP | 0 997 273 | A2 | 5/2000 |
| GB | 1348021 | A * | 3/1974 |
| WO | WO 99/06211 | | 2/1999 |
| WO | WO 00/06384 | | 2/2000 |

* cited by examiner

*Primary Examiner*—Daniel J. Colilla
*Assistant Examiner*—Jill E. Culler
(74) *Attorney, Agent, or Firm*—Jones Tullar & Cooper PC

(57) ABSTRACT

A printing unit is comprised of a pair of cylinders, such as a forme cylinder and a transfer cylinder. These two cylinders, together with a third cylinder, form a printing site. The third cylinder is in contact with the transfer cylinder. The forme cylinder and the transfer cylinder are coupled together and form a drive system which is driven by a common drive motor during the printing process. Power is transmitted from the transfer cylinder to the forme cylinder. The drive system for the cylinder pair and a drive for the third cylinder are coupled to each other by a mechanical coupling for selective coupling and decoupling.

14 Claims, 9 Drawing Sheets

01

PRINTING UNIT

FIELD OF THE INVENTION

The present invention is directed to a printing unit including at least first and second printing pairs or couples. A satellite cylinder cooperates with a transfer cylinder of the first pair. A drive assembly is provided for the cylinders.

BACKGROUND OF THE INVENTION

A printing press is known from EP 0 644 048 B1 in which pairs of cylinders, each consisting of a forme cylinder and a transfer cylinder, are mechanically fixedly coupled. Each cylinder pair has its own drive motor. The cylinder pairs themselves cannot be coupled to each other.

DE 44 30 693 A1 discloses printing units of a printing press with separate configurations of cylinders which are driven individually, or in groups. Cylinders, or groups of cylinders, are not in a driven connection with each other.

A four-cylinder printing unit is known from DE 196 03 663 A1. The two transfer cylinders which cooperate with each other are fixedly coupled to each other and can be selectively driven by the drive mechanism of one or of both associated forme cylinders. In one embodiment, a pair of cylinders, consisting of a forme cylinder and a transfer cylinder, which can be driven at the forme cylinder, can be placed against this four-cylinder printing unit, and can be coupled into the drive linkage between the two first mentioned transfer cylinders for synchronization, or to attain correctly registered printing.

EP 0 997 273 A2 discloses a four-cylinder printing unit, in which the four cylinders can be driven by two drive motors. Two couplings at the journals of the two forme cylinders, and two gear wheels, which can be axially displaced on the journals of the two transfer cylinders, facilitate the formation of different drive linkages.

WO 00/06384 A1 discloses printing units with satellite cylinders in a modular construction which make possible a multitude of production possibilities by use of flexible arrangements. Each satellite cylinder has its own drive motor or can be coupled to one of the cooperating cylinder pairs.

SUMMARY OF THE INVENTION

The object of the present invention is directed to providing a printing unit.

In accordance with the present invention, this object is attained by the provision of a printing unit having a first cylinder pair comprised of a first forme cylinder and a first transfer cylinder. A second cylinder pair is also provided and is comprised of a second forme cylinder and a second transfer cylinder. A satellite cylinder, together with the transfer cylinders, forms a printing location. A drive for the first forme cylinder, and a drive for the first transfer cylinder form a coupled drive linkage which, during printing is driven by a common drive motor on the transfer cylinder. A drive mechanism for the satellite cylinder can be selectively switched and coupled, through a first coupling, with the drive linkage of the first cylinder pair. With the coupling engaged, the drive is taken off the drive motor and transferred to the satellite cylinder.

The advantages which can be gained by the present invention lie, in particular, in that a large operational diversity and variability of a printing unit or of compound cylinders, together with a high degree of operational dependability, is provided by redundancy, without each cylinder being provided with its own drive mechanism. The present invention unites the advantages of the high degree of flexibility provided by the expensive and elaborate single drive technology with the advantages of coupled cylinder groups, namely the savings of motors and the mechanical synchronization of the connected cylinders.

As a rule, by the optimized arrangement of switchable couplings and motors, as many of the desired operating modes are possible as would be provided with an embodiment where all cylinders are provided with separate motors. Thus, with the coupling released, it is possible to move cylinders, or groups of cylinders, independently of each other, which movement is required, for example, when the printing formes or rubber blankets are exchanged, when a paper web is drawn in, or when rollers and cylinders are independently inked or washed. In many cases, an auxiliary drive mechanism can therefore be omitted, since the function of this auxiliary drive mechanism can be taken over by the main drive mechanisms, if the couplings are appropriately switched. In the same way, is it possible to perform the switching of individual cylinders or cylinder groups of connected larger cylinders, in that new drive linkages are formed by releasing couplings and activating other couplings.

Moreover, a substantial advantage lies in the option of standardizing individual small groups, for example a pair of cylinders consisting of a forme cylinder and a transfer cylinder with an appropriate coupling, and of combining them in any desired way, in response to a request made in a purchase order, into larger units. An above discussed pair of cylinders can also represent a standard group, together with a counter-pressure cylinder. The journals of the cylinders can be embodied as needed, for example selectively, with or without coupling, with a gear wheel which is fixed against relative rotation or can be fixed in place, matching a first or second drive level.

In a preferred embodiment, the transfer cylinder of the pair is driven. In this way, it is possible to definitely define a flow of moments up to an inking unit, which aids in improving the printing quality.

In particular, in connection with printing units which can be switched from rubber-on-rubber to rubber-on steel operation, i.e. in which at least one of the transfer cylinders can be selectively placed against a counter-pressure cylinder or against a second transfer cylinder, a reversal of the direction of rotation of one or several cylinders is necessary, depending on the printing unit, and thus requires the release of drive linkages and the formation of new drive linkages. With a five-cylinder printing unit, an embodiment with one drive motor for each pair of forme and transfer cylinders is advantageous, and in which the counter-pressure cylinder can be coupled with one of the two drive motors, or with both drive motors, or with cylinder pairs, depending on the paper guidance and the mode of operation.

In such embodiments, a flying plate exchange is possible for a five-cylinder printing unit by use of only two drive motors and only two couplings. This can be accomplished without the need for auxiliary drives for subsequent cylinder acceleration or for appropriate devices for circumferential registration changes and/or for finding the register, which are typically necessary prior to recoupling.

A one-sided printing forme change is possible in an embodiment with only one drive motor and with only two couplings, for example, for preparing an imprint.

An embodiment, in the form of a four-cylinder printing unit expanded by a further cylinder pair, for example, is advantageous for a six-cylinder y- or lambda-printing unit, which can be flexibly employed, for example, for a 2/1 production run, for the flying one-sided plate change, or during the imprint function in the course of 1/1 printing.

The present invention can also be employed particularly advantageously and efficiently in seven-cylinder, nine-cylinder or ten-cylinder printing units, when maximum flexibility, together with a minimal number of motors, is required.

In the situation of several pairs of cylinders working together directly or via a counter-pressure cylinder, there is the possibility of changing the relative rotational position of the forme cylinders with respect to each other, for example for the adjustment of the circumferential or ink registration, by uncoupling.

The great operational dependability provided by the present invention, because of the redundancy in the number of usable drive motors, which provides a so-called back-up function, is also particularly advantageous in the situation of several drive mechanisms which can by connected by couplings.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
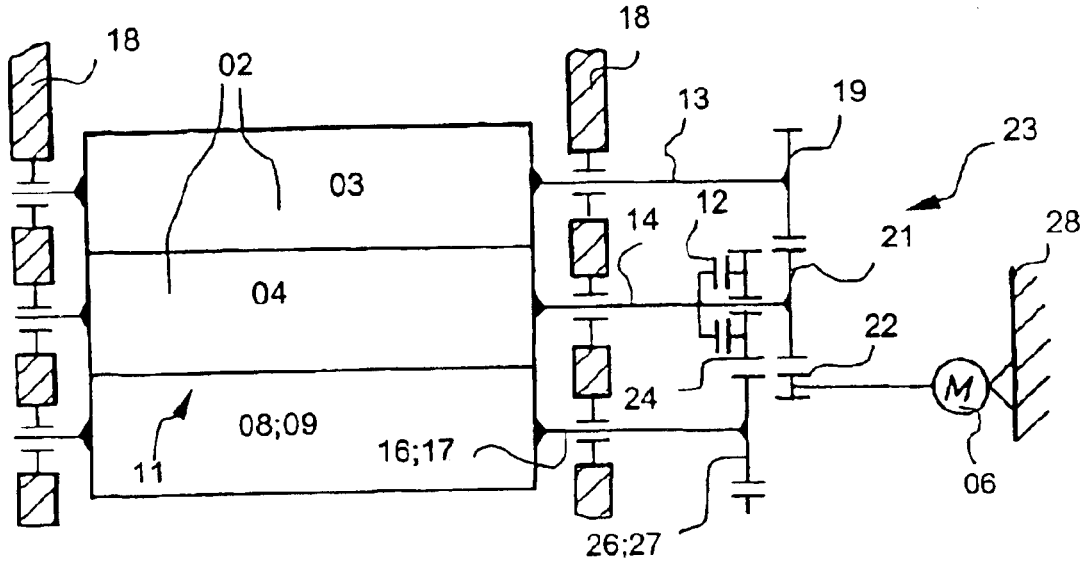
FIG. 1, a schematic representation of a first preferred embodiment of a printing unit in accordance with the present invention with three cylinders, FIG. 2, a schematic representation of a second preferred embodiment of a printing unit with three cylinders, FIG. 3, a schematic representation of a third preferred embodiment of a printing unit with three cylinders, FIG. 4, a schematic representation of a fourth preferred embodiment of a printing unit with three cylinders, FIG. 5, a schematic representation of a fifth preferred embodiment of a printing unit with four cylinders, FIG. 6, a schematic representation of a sixth preferred embodiment of a printing unit with four cylinders, FIG. 7, a schematic representation of a seventh preferred embodiment of a printing unit with five cylinders, FIG. 8, a schematic representation of an eighth preferred embodiment of a printing unit with five cylinders, and in FIG. 9, a schematic representation of a ninth preferred embodiment of a printing unit with five cylinders.

A printing unit 01 of a printing press, in particular a printing unit 01 of a web-fed rotary printing press, has a first pair 02 of cooperating cylinders 03, 04, for example a first forme cylinder 03 and a first transfer cylinder 04 cooperating with it, as may be seen in FIG. 1. For all of the preferred embodiments, the first pair of cooperating cylinders 02 can also be fixedly or switchably mechanically connected with an ink and/or a damping unit, not specifically shown. The drive of the first cylinder pair 02 is mechanically coupled and is provided by a common drive motor 06 during printing production or operation of the web-fed rotary printing press. The common drive motor 06 drives the first transfer cylinder 04, which drives the first forme cylinder 03 by friction or via a mechanical coupling, for example a positive coupling through gear wheels.

It is advantageous in regard to the driving of the transfer cylinder 04 that, in this way, there is a definite flow of torque or moments from the drive motor 06 to the transfer cylinder 04, to the forme cylinder 03 and to the drive linkage for an ink unit, which may optionally be provided.

Together with a third cylinder 08 or 09, which may be, for example a satellite cylinder 08, such as, for example a steel cylinder 08, or a second transfer cylinder 09, the first transfer cylinder 04 of the first cylinder pair 02 constitutes a printing location 11, where the two cylinders 04 and 08, or 09, act together in a print-on position through a web that is running between the cylinders 04 and 08, or 04 and 09, for example a web of material to be imprinted such as a paper web. In a print-on position, this third cylinder 08 serves as a backstop and vice versa. The drive mechanism of the first pair of cooperating cylinders 02 and a drive for the third cylinder 08, or 09 can be connected with each other by use of a switchable mechanical coupling 12, for example by use of a switchable connector 12.

In a first group of preferred embodiments, in each three-cylinder group, as depicted in FIGS. 1, 2, 3 and 4, the third cylinder 08, 09 is embodied as a satellite cylinder 08. In the first case, the printing unit 01 represents, for example, a three-cylinder color deck, or a part of a larger printing system with counter-pressure cylinders 08 embodied as satellite cylinders.

In the first preferred embodiment of FIG. 1, the third cylinder 08 is embodied without its own drive mechanism. The drive motor 06 of the first cylinder pair 02 drives the transfer cylinder 03, which drives the forme cylinder 04 by friction.

The cylinders 03, 04, and 08 or 09 each have journals 13, 14,16 or 17 arranged on the drive side, which journals are seated on both faces of a frame wall 18, for example a housing wall 18. Gear wheels 19 and 21 are respectively arranged, fixed against relative rotation, on the drive side end of the journal 13 of the forme cylinder 03, as well as of the journal 14 of the transfer cylinder 04. These gear wheels 19 and 21 are in engagement in such a way that a solid mechanical coupling between the cooperating forme cylinder 03 and transfer cylinder 04 exists.

The gear wheel 21 of the transfer cylinder 04 can be driven directly, or via a gear 22, such as, for example a pinion gear 22 of the drive motor 06 and, together with the gear wheel 19, constitutes a fixed drive linkage 23 for the first pair of cooperating cylinders 02. A second gear wheel 24 is rotatably seated on the journal 14 of the transfer cylinder 04. By use of the switchable coupling 12, gear wheel 21 can be selectively connected, fixed against relative rotation, with the journal 14. This gear wheel 24 positively engages a gear wheel 26 or 27 which is arranged, fixed against relative rotation, on the journal 16 or 17 of the third cylinder 08, 09, respectively. The common drive motor 06 preferably is arranged, fixed in place in respect to the frame wall 18, for example on a housing wall 28, or its own frame. If the cylinder 04 is pivotably seated, for example by the use of eccentric bushings, the common drive motor 06 can also be arranged fixed in place in relation to the transfer cylinder 04 to be driven, or the pinion gear 22 and gear wheel 21, which are in engagement with each other, can be provided with sufficient play. The third cylinder 08, 09 can be stopped independently of the first pair 02 by releasing the coupling 12, or is movable in a further drive linkage, not represented, while the pair 02 is movable, and can be braked or accelerated again, for example to accomplish for a printing forme or rubber blanket change, for pre-inking or for washing, independently of the third cylinder 08, 09. With the coupling 12 engaged, the third cylinder 08, 09 can be driven mechanically and synchronously with respect to the pair of cooperating cylinders 02. With a drawn-in web in particular, it is possible to set up one of the cylinders 03, 04, or the inking unit, without the web being conveyed.

Figure 2:
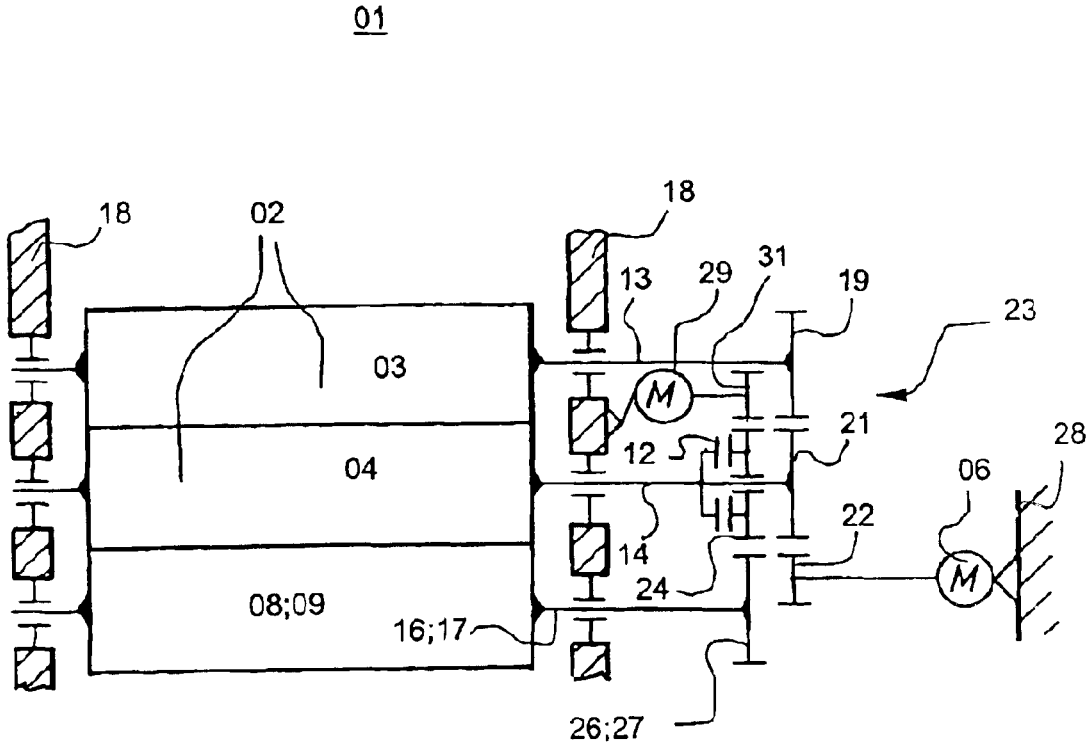

In the second preferred embodiment of FIG. 2, the arrangement in FIG. 1 has an additional, second drive motor 29, which meshes, via a third gear 31, which is, for example a pinion gear 31, with the second gear wheel 24, which can be selectively connected, fixed against relative rotation, on the journal 14. In comparison with the first preferred embodiment, the third cylinder 08,09 of the second embodiment can additionally be independently driven when the coupling 12 is released. With the coupling 12 engaged, a common, redundant, drive by both drive motors 06 and 29 is possible.

Figure 3:
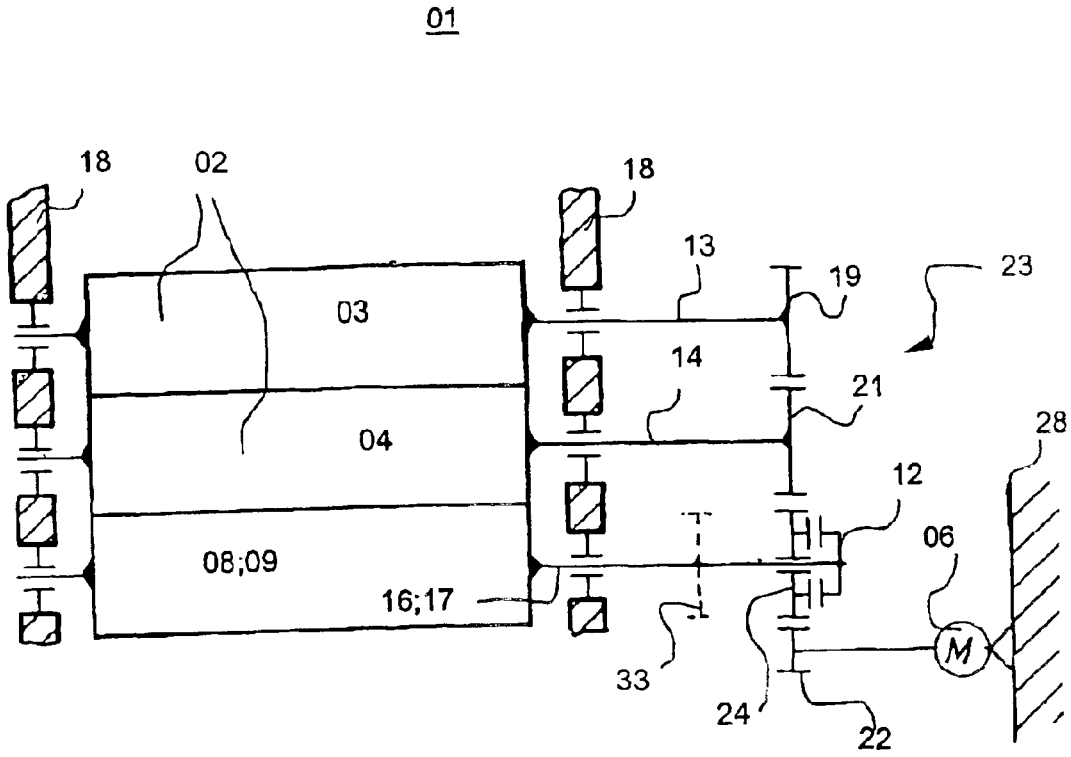

In contrast to FIGS. 1 and 2 a third preferred embodiment, as seen in FIG. 3, has the switchable coupling 12 and the cooperating, rotatably seated second gear wheel 24 on the journal 16, 17 of the third cylinder 08, 09, respectively. Via the associated drive motor pinion gear 22, the drive motor 06 drives the second gear wheel 24, which is seated so it can selectively be fixed in place and is in engagement with the gear wheel 21 of the transfer cylinder 04 which, in turn, is in engagement with the gear wheel 19 of the forme cylinder 03. With the coupling 12 released, the drive motor 06, together with the gear wheels 24, 21 and 19, constitutes the fixed drive linkage 23. By engaging the coupling 12, the satellite cylinder 08 can also be driven. As indicated in dashed lines in FIG. 3, the journal 16, 17 can have a further or fourth gear wheel 33, which is arranged fixed against relative rotation and which meshes, for example, with a gear wheel, that is not specifically represented, of a further cylinder or drive linkage.

Figure 4:
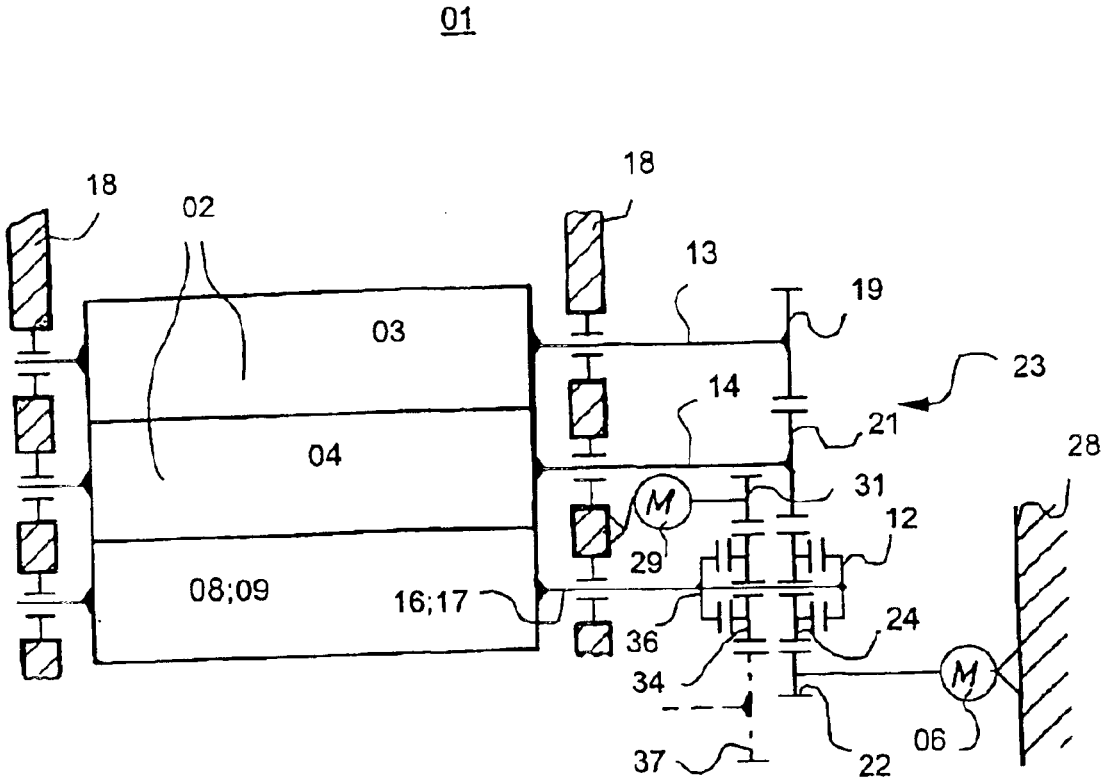

FIG. 4 shows a fourth preferred embodiment of the present invention which is a further development of the third preferred embodiment represented in FIG. 3. Besides the rotatably seated second gear wheel 24, the journal 16, 17 of the third cylinder 08, 09 has a fifth, rotatably seated gear wheel 34. This can be selectively connected, fixed against relative rotation, with the journal 16, 17 by use of a switchable coupling 36, for example a second connector 36, arranged on the journal 16, 17. As also represented in FIG. 4, the gear wheel 34 can be driven via the pinion or third gear 31 by the second drive motor 29, similar to the second preferred embodiment. The fifth, rotatably seated gear wheel 34 for example also meshes with a gear wheel 37, shown in dashed lines, of a further cylinder or drive linkage, not specifically represented. By use of the two couplings 12, 36 it is selectively possible to independently drive all cylinders 03, 04, 08 or 02 by both drive motors 06, 29 together, or the first pair of cooperating cylinders 02 and the third cylinder 08, 09 if required, together with a further drive linkage.

Figure 5:
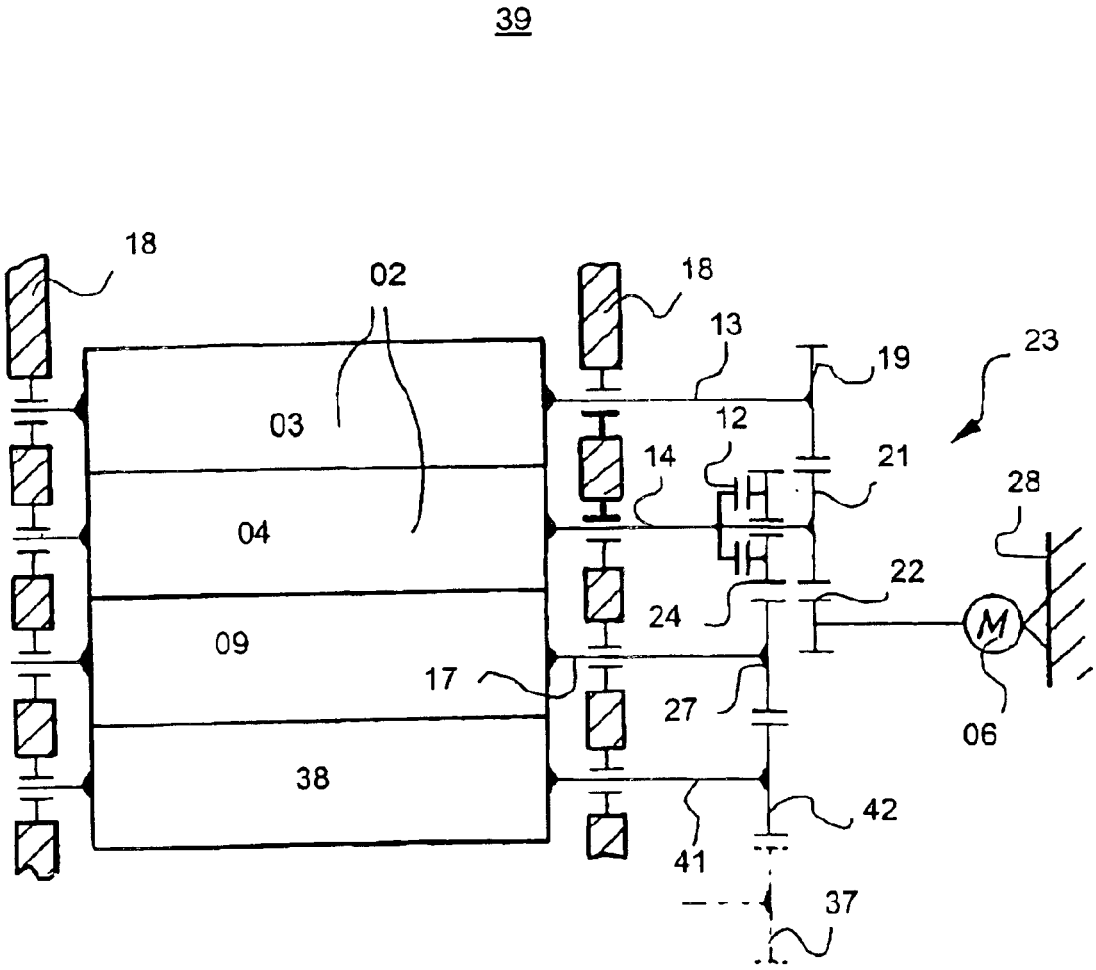
Figure 6:
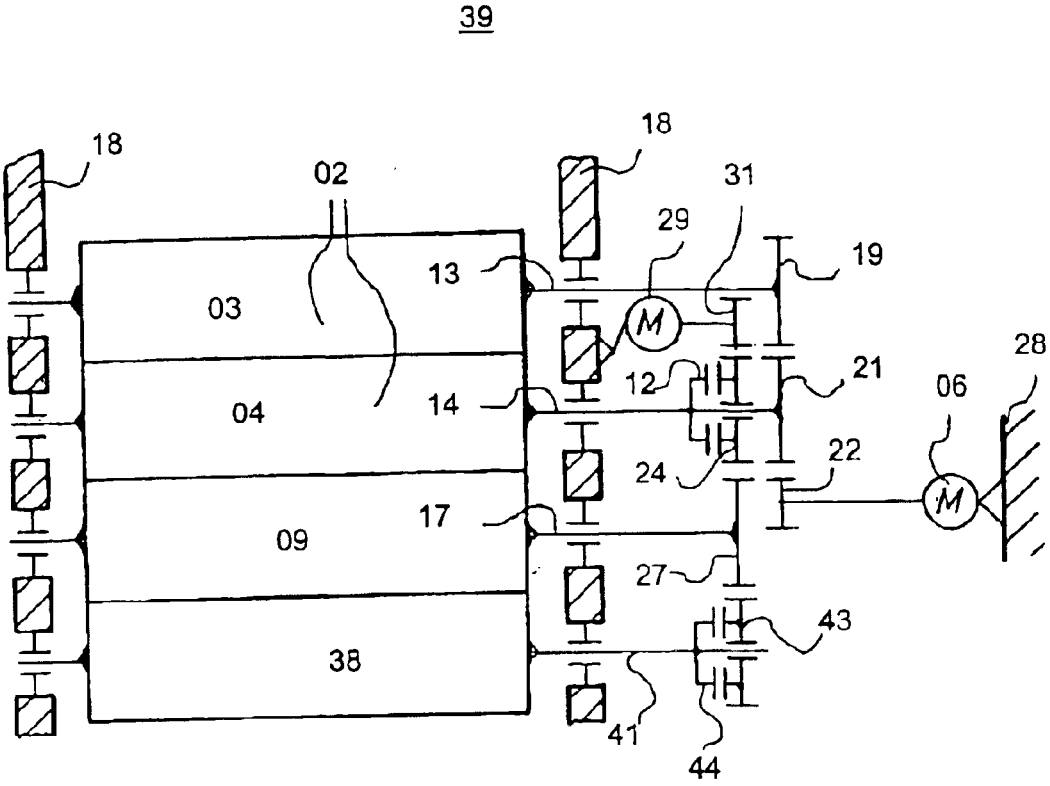

In a second group of preferred embodiments, which are shown in FIGS. 5 and 6, the third cylinder 08, 09, which cooperates with the first pair of cooperating cylinders 02, is embodied as a second transfer cylinder 09 and cooperates, in turn, with a second cylinder 38, for example a second forme cylinder 38. By way of example and differing from the preferred first to fourth embodiments for the three-cylinder printing unit 01, FIGS. 5 and 6 show two advantageous embodiments for linking the drive from the second transfer cylinder 09 to the cooperating second forme cylinder 38 of a four-cylinder printing unit 39.

In the fifth preferred embodiment, as shown in FIG. 5, the second forme cylinder 38 has a gear wheel 42 seated, fixed against relative rotation, on its journal 41, which second forme cylinder gear wheel 42 meshes with the gear wheel 27 of the second transfer cylinder 09 and is in a fixed drive linkage with it.

Referring now to FIG. 6, in the sixth preferred embodiment of the present invention, the journal 41 of the second transfer cylinder has a rotatably seated gear wheel 43, which can be selectively coupled, fixed against relative rotation, on the journal 41 via a switchable coupling 44, for example a connector 44, arranged on the journal 41.

The embodiments represented in FIGS. 3 and 4 are also possible for the drive configuration of the first pair of cooperating cylinders 02, together with the second transfer cylinder 09.

Figure 7:
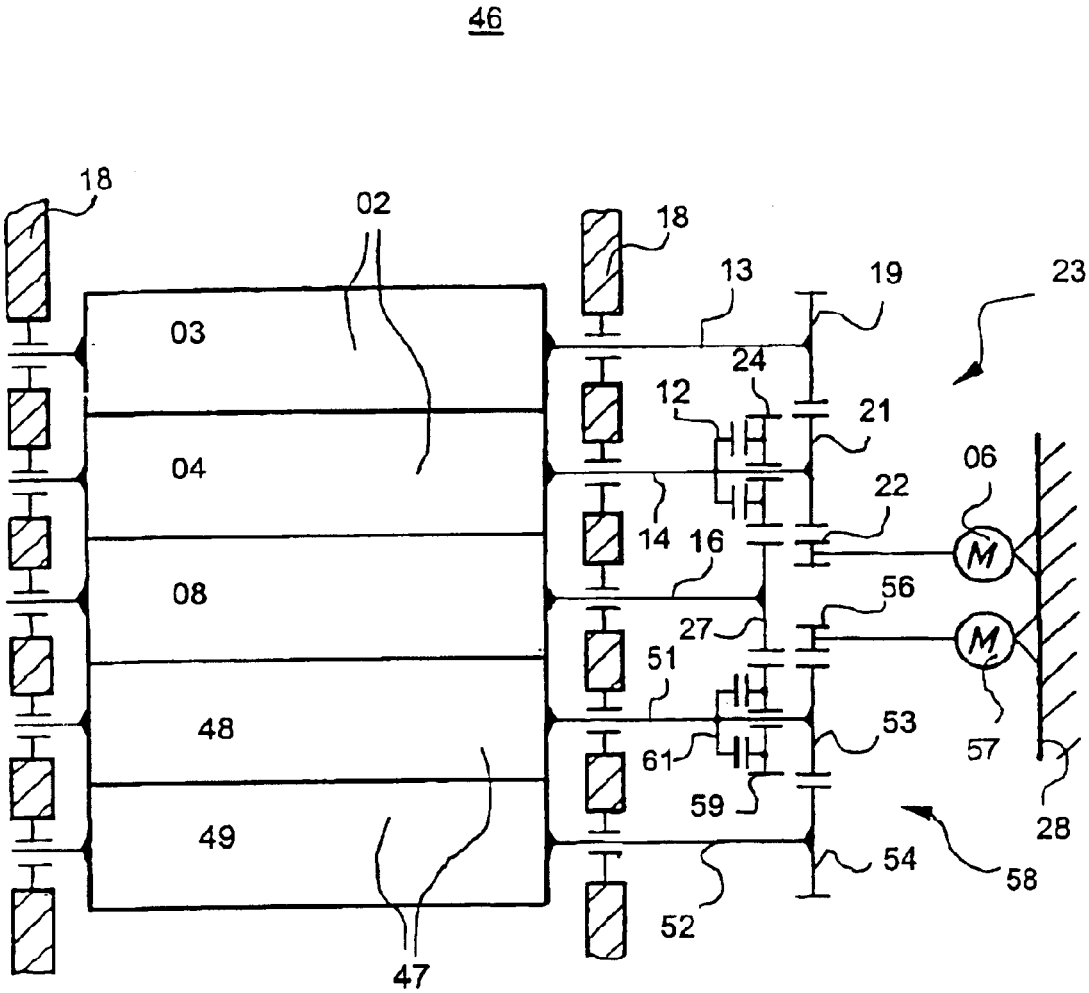
Figure 8:
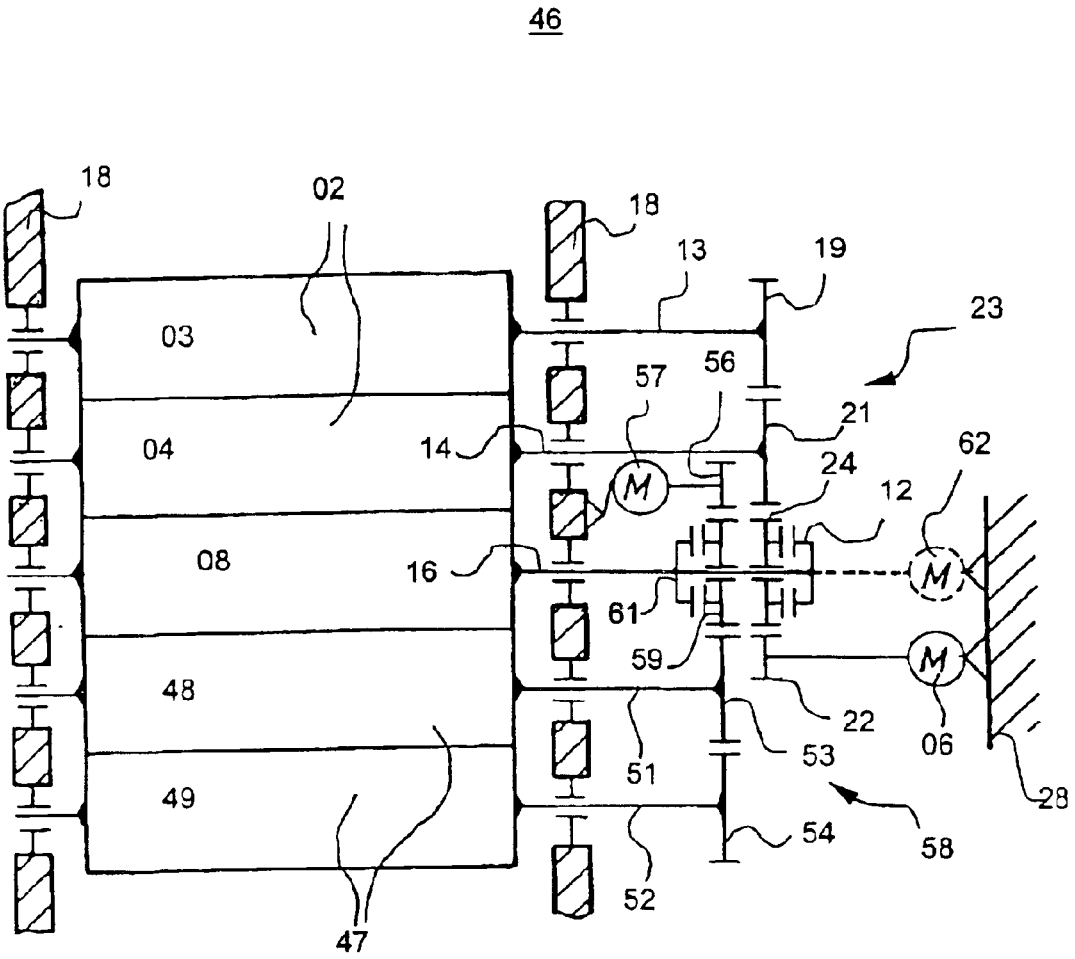
Figure 9:
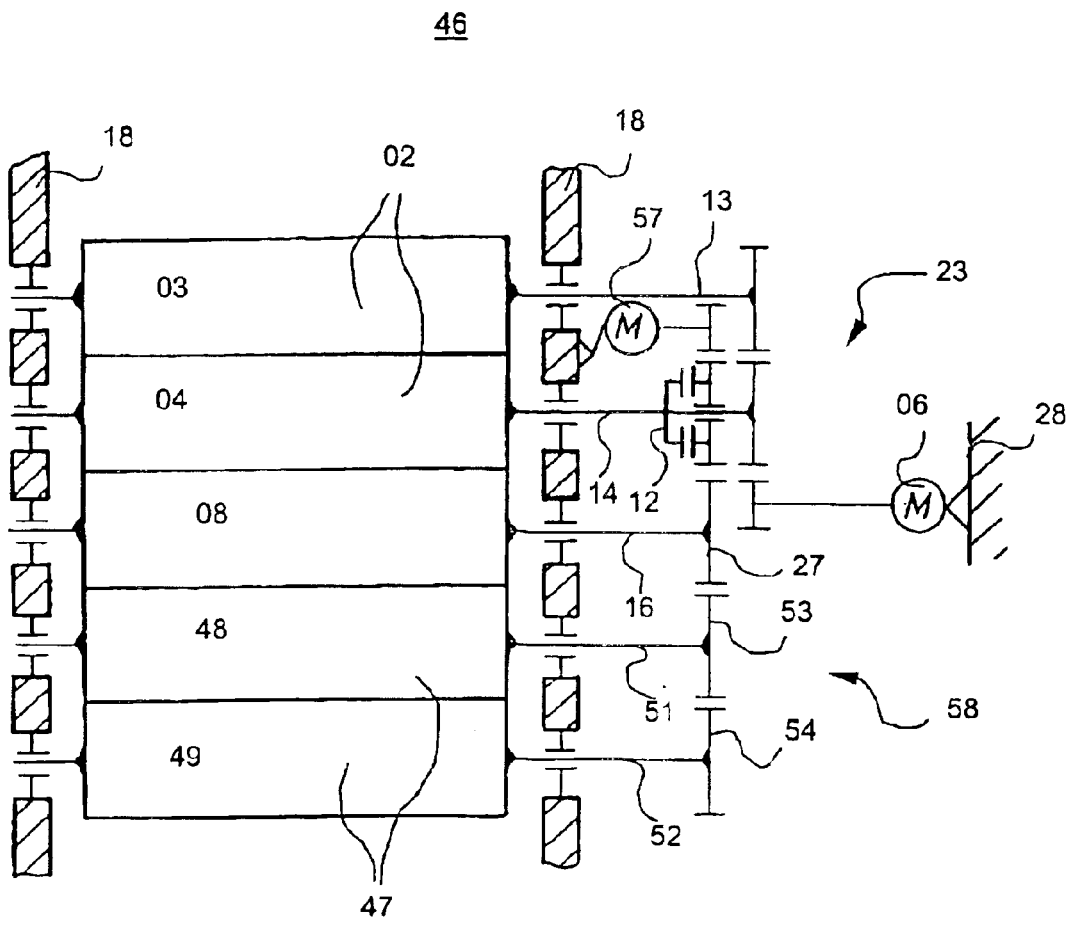

In a third group of preferred embodiments which are shown in FIGS. 7 to 9 for a five-cylinder printing unit 46, for example as a semi-satellite, the third cylinder 08, which cooperates with the first cylinder pair 02, is embodied, the same as in the first group, as a satellite cylinder 08 which, however, cooperates with a second pair 47 of cylinders 48, 49, for example a second transfer cylinder 48 and a second forme cylinder 49.

For the two cylinder pairs 02, 47, the arrangement represented in FIG. 7 results, with the second cylinder pair 47 being laterally reversed in respect to the satellite cylinder 08, from the arrangement in accordance with the first preferred embodiment, as shown in FIG. 1. The cylinders 48, 49 of the second cylinder pair 47 also have journals 51, 52, respectively assigned to the drive side and seated in the frame wall 18. Gear wheels 54, 53 are arranged, fixed against relative rotation, on the drive side of the journal 52 of the second forme cylinder 49, as well as the drive side of the journal 51 of the second transfer cylinder 48, and are in engagement with each other in such a way that a solid coupling exists between the cooperating second forme cylinder 49 and the second transfer cylinder 48. The gear wheel 53 of the second transfer cylinder 48 is driven via a gear 56, for example a pinion gear 56 of the second cylinder pair drive motor 57, and constitutes a fixed drive linkage 58 for the second cylinder pair 47. A second gear wheel 59, analogous to the second gear wheel 24, is rotatably seated on the journal 51 of the second transfer cylinder 48 which, however, can be selectively connected, fixed against relative rotation, with the second transfer cylinder journal 51 by operation of a switchable coupling 61, for example a connector 61. The same as the gear wheel 24 of the first pair of cooperating cylinders 02, this gear wheel 59 positively engages the satellite cylinder gear wheel 27, which gear wheel 27 is arranged, fixed against relative rotation, on the journal 16 of the satellite cylinder 08. The drive motor 57 is also preferably arranged to be stationary in respect to the frame wall 18 or 28.

In contrast to FIG. 7, the eighth preferred embodiment in accordance with FIG. 8 has the arrangement represented in FIG. 3, but without a gear wheel 33, arranged fixed against relative rotation, and with the second cooperating pair of cylinders 47 laterally reversed in respect to the satellite cylinder 08, but on a second drive level. The journal 16 of the satellite cylinder 08 has both switchable couplings 12 and 61, as well as the cooperating gear wheel 24 and 59, which are rotatably seated on the journal 16. With the coupling 12 or 61 released, the drive motor 06, 57, together with the gear wheels 19 and 21, or 54 and 53, as well as the pinion gears 22 or 56, constitutes the fixed drive linkage 23 or 58. The satellite cylinder 08 can be driven by engaging the coupling 12 and/or 61. In the two preferred embodiments in accordance with FIGS. 7 and 8, it is also possible to drive all cylinders 03, 04, 08, 48, 49 by operation of one or both drive motors 06, 57.

The variation which is indicated in dashed lines in FIG. 8 is one wherein, instead of the drive motor 57 with associated pinion gear 56, a drive motor 62 directly drives the journal 16 of the satellite cylinder 08. This leads to a further possibility for the realization of a fixed cylinder of a coupling pair 02 with a drive motor 06, wherein the cylinder pair 02 can be selectively coupled to the third cylinder 08.

A five-cylinder printing unit 46 is represented in FIG. 9, in which the drive of the first forme cylinder 03, the first transfer cylinder 04 and the satellite cylinder 08 takes place by use of the two drive motors 06, 57 and the coupling 12 in accordance with FIG. 2 or 5. The gear wheel 27, which is seated, fixed against relative rotation, on the journal 16 of the satellite cylinder 08, meshes with a gear wheel 53, which is also arranged, fixed against relative rotation, on the journal 51 of the second transfer cylinder 48 and which itself meshes with the gear wheel 54 arranged on the journal 52 of the second forme cylinder 49. With this configuration, the coupling 61 from FIG. 7 or 8 is omitted and results in a fixed drive linkage 58 between the satellite cylinder 08, the second transfer cylinder 48 and the second forme cylinder 49. As shown by way of example in FIGS. 8 and 9, the drive linkages 23 and 58 must be arranged on different levels.

The solutions represented in the nine preferred embodiments depict basic configurations, which can be standardized, also for the flexible configuration of larger cylinder connections, such as Y or lambda embodied six- or seven-cylinder printing units, or configurations of nine- or ten-cylinder printing units that may be embodied as a satellite unit or satellite system.

The driving of the gear wheels 21, 24, 53, 59, disclosed in the preferred embodiments and as represented in FIGS. 1 to 9, by the use of drive motors 06, 57 via associated gears 22, 31 or 56, embodied as pinion gears 22, 32 or 56, can also take place in a different way. For example, the gear wheels 21, 24, 53, 59 can also be driven by the respective drive motors 06, 57 by drive belts. It is also possible to drive the journal 14, 16, 17, 51, which, in the drawings, is driven respectively via the pinion gears 22, 31 or 56 and the cooperating gear wheel 21, 24, 53, 59, directly by use of the rotor of a drive motor 06, 57, possibly coupled by the interposition of a joint. Such a direct drive can take place, by way of example, in the variation represented in dashed lines in FIG. 8 by operation of the drive motor 62 for the journal 16.

While preferred embodiments of a printing unit comprising a drive system that is coupled in a fixed manner in accordance with the present invention have been set forth fully and completely hereinabove, it will be apparent to one of skill in the art that various changes, in for example, the overall sizes of the cylinders, the specific nature of the couplings and the like could be made without departing from the true spirit and scope of the present invention which is accordingly to be limited only by the following claims.

What is claimed is:

1. A printing unit comprising:

a first printing pair including a first forme cylinder and a first transfer cylinder;

a second printing pair including a second forme cylinder and a second transfer cylinder;

a satellite cylinder, said satellite cylinder cooperating with said first and said second transfer cylinders to form a printing location;

a first drive mechanism for said first forme cylinder and for said first transfer cylinder, said first drive mechanism forming a first fixedly coupled drive linkage during printing;

a first common drive motor for said first drive linkage, said first common drive motor being connected to said first transfer cylinder;

a satellite drive mechanism for said satellite cylinder; and a first coupling between said satellite drive mechanism and said first drive linkage, said first common drive motor driving said satellite cylinder through said coupling and driving said first printing pair through said satellite cylinder through said first drive linkage when said first coupling is engaged.

2. The printing unit of claim 1 further including a first forme cylinder gear wheel and a first transfer cylinder gear wheel, said first forme cylinder and said first transfer cylinder being fixedly connected by said first forme cylinder gear wheel and said first transfer cylinder gear wheel.

3. The printing unit of claim 2 wherein said first forme cylinder has a first forme cylinder journal and said first transfer cylinder has a first transfer cylinder journal, said first forme cylinder gear wheel being fixed against relative rotation on said first forme cylinder journal and said first transfer cylinder gear wheel being fixed against relative rotation on said first transfer cylinder journal.

4. The printing unit of claim 1 wherein said first coupling is a switchable coupling arranged between said satellite drive mechanism and said first drive linkage.

5. The printing unit of claim 4 wherein said first transfer cylinder has a first transfer cylinder journal and wherein said satellite cylinder has a satellite cylinder journal and further wherein said first coupling is fixed against relative rotation on one of said first transfer cylinder journal and said satellite cylinder journal and cooperates with a gear wheel rotatably seated on said one of said first transfer cylinder journal and said satellite cylinder journal and selectively secures said gear wheel to said one of said first transfer cylinder journal and said satellite cylinder journal.

6. The printing unit of claim 5 wherein said coupling and said rotatable gear wheel are arranged on said satellite cylinder journal.

7. The printing unit of claim 6 wherein said rotatable gear wheel which can be selectively fixed in place meshes with said first transfer cylinder gear wheel which is arranged fixed against rotation on said first transfer cylinder journal.

8. The printing unit of claim 6 wherein said first printing cylinder pair is driven by said first common drive motor through said rotatably seated gear wheel on said satellite cylinder fixed in place by said first coupling.

9. The printing unit of claim 1 further including a second common drive motor.

10. The printing unit of claim 9 further including a satellite cylinder journal with a satellite cylinder gear wheel rotatably supported on said satellite cylinder journal, said second drive motor having a second drive motor gear wheel engageable with said satellite cylinder gear wheel to drive said satellite cylinder gear wheel.

11. The printing unit of claim 1 wherein said printing unit is a five cylinder printing unit.

12. The printing unit of claim 1 further including a fixed drive linkage formed by said second forme cylinder and said second transfer cylinder.

13. The printing unit of claim 12 wherein said fixed drive linkage is driven by said satellite drive mechanism.

14. The printing unit of claim 1 wherein each of said first forme cylinder and said first transfer cylinder cooperating with it, and said second forme cylinder and said second transfer cylinder cooperating with it constitute a fixedly coupled drive linkage, each said fixedly coupled drive linkage being driven by its own drive motor, said satellite cylinder being selectively mechanically coupled to and released from said fixedly coupled drive linkages.

* * * * *